US007625858B2

(12) United States Patent
Mohammadi

(10) Patent No.: US 7,625,858 B2
(45) Date of Patent: Dec. 1, 2009

(54) FABRIC CONDITIONING COMPOSITIONS

(75) Inventor: Mansur Sultan Mohammadi, Bebington (GB)

(73) Assignee: The Sun Products Corporation, Wilton, CT (US)

( * ) Notice: Subject to any disclaimer, the term of this patent is extended or adjusted under 35 U.S.C. 154(b) by 0 days.

(21) Appl. No.: 12/229,265

(22) Filed: Aug. 21, 2008

(65) Prior Publication Data

US 2009/0054297 A1 Feb. 26, 2009

(30) Foreign Application Priority Data

Aug. 24, 2007 (GB) ..... 0716509.5

(51) Int. Cl.
*C11D 1/645* (2006.01)

(52) U.S. Cl. ..... 510/527; 510/522

(58) Field of Classification Search ..... 510/522, 510/527

See application file for complete search history.

(56) References Cited

U.S. PATENT DOCUMENTS

| | | | | |
|---|---|---|---|---|
| 5,133,885 | A | 7/1992 | Contor et al. | |
| 5,545,340 | A | 8/1996 | Wahl et al. | |
| 5,580,481 | A | 12/1996 | Sakata et al. | |
| 5,747,443 | A | 5/1998 | Wahl et al. | |
| 5,773,409 | A * | 6/1998 | Haq et al. | 510/521 |
| 6,759,383 | B2 * | 7/2004 | Wahl et al. | 510/522 |
| 2003/0119701 | A1 | 6/2003 | Demeyere et al. | |
| 2003/0139313 | A1 | 7/2003 | Turner et al. | |
| 2009/0054296 | A1 | 2/2009 | Mohammadi | |

FOREIGN PATENT DOCUMENTS

| | | |
|---|---|---|
| WO | WO 03022973 | 3/2003 |

OTHER PUBLICATIONS

International Search Report for PCT Application PCT/EP2008/060829 completed Nov. 14, 2008, mailed Apr. 12, 2008, 3pgs.
Office Communication mailed Dec. 10, 2008, for U.S. Appl. No. 12/229,262, filed Aug. 21, 2008, 6 pgs.

* cited by examiner

*Primary Examiner*—John R Hardee
(74) *Attorney, Agent, or Firm*—Sterne, Kessler, Goldstein & Fox, PLLC

(57) ABSTRACT

The concentrated liquid fabric softening composition of the present invention comprises an ester-linked triethanolamine (TEA) quaternary ammonium fabric softening material having an Iodine Value of between 0 and 60 and comprising a mixture of at mono-, di- and tri-ester linked components; a single long chain cationic surfactant which has one or more ethoxylate groups and preferably has a methylsulphate counter-ion, and a co-fragmenting agent which is a polyol selected from trihydric and polyhydric polyols. The compositions have a desirable pearly appearance which is stable across a range of storage temperatures.

13 Claims, No Drawings

FABRIC CONDITIONING COMPOSITIONS

FIELD OF THE INVENTION

The present invention relates to fabric conditioning compositions. More specifically, the invention relates to pearly cationic fabric softening compositions comprising a linear cationic surfactant and a low molecular weight polyol.

BACKGROUND OF THE INVENTION

Liquid fabric conditioners are compositions that soften fabric. Such compositions are typically contacted with fabric in the rinse cycle of the wash process. Consumers desire an attractive appearance and excellent pourability of such liquids. Non-ionic ethoxylated surfactants with bulky ethoxylate (EO) groups help to make concentrated fabric conditioning compositions pourable. Non-ionic surfactants achieve this low viscosity by fragmenting the spherical liposome droplets into lamellar 'sheets' or disks of flat structure. Such non-spherical structures give the liquid a pearly lustre that is particularly liked by consumers. However, stability problems are known to persist with regard to the storage stability of compositions containing ethoxylate surfactants, particularly relating to optical and rheological aspects. The liquid thickens in the bottle and suffers loss of its pearly lustre. These problems are exacerbated at higher storage temperatures, such as are experienced in warmer climates or when ambient temperature rises. Thickening in the bottle leads to wasted product and, when used in automatic washing machines, messy residues being left in the dispenser draw of the machine. Ultimately this leads to a limited shelf life.

This high temperature stability issue arises from the collapse of the ethoxylate groups at elevated temperature and loss of steric repulsion that these groups afford the lamellar fragments as described in 'Colloids and Surfaces A 288 (2006), 96-102, Colloidal stability of di-chain cationic and ethoxylated non-ionic surfactant mixtures used in fabric softeners'. The fragments adhere together and this size enlargement results in increase in viscosity of the composition and loss of the pearly lustre. At low ambient temperatures ethoxylate surfactants provide acceptable stability to the fragment structures.

Numerous publications disclose ways of improving the high temperature storage stability of liquid fabric softeners stabilised by ethoxylated non-ionic surfactants, for example, EP 523,922 and WO 01/46360.

The effect of ethoxylated nonionics with bulky headgroups on softener compositions is taught in WO 95/27769 where high levels of ethoxylated nonionics can be used to solubilise fabric softeners into micelles or micellar structures. These translucent liquids are claimed to be stable on storage and have good softening, dispensing and dispersing properties. Non-surfactant co-solubilisers such as urea, acid amides, citric acid, polycarboxylic acid, glycerol, sorbitol, sucrose and PEGs of MW ~200 to 6000 are mentioned.

WO 95/27771 teaches that amphoteric surfactants including betaines and tegobetaines can also solubilise fabric softeners into micellar structures to produce translucent liquids. Non-surfactant co-solubilisers are mentioned as in WO 95/27769. The compositions can be made either by co-melting of surfactant with softener and then adding to water or by sequential addition of components.

WO 93/23510 discloses the use of highly ethoxylated nonionic surfactants, cationic surfactants and their mixtures as viscosity/dispersibility modifiers for di-ester quaternary ammonium compounds to produce concentrated liquid compositions with improved storage stability and viscosity characteristics. An optional liquid carrier can be included that is a mixture of water and low molecular weight solvents such as mono-, di-, tri- and poly-hydric alcohols. The composition is prepared by adding the melt of the softener to a solution of the single chain cationic surfactant. As mentioned above the use of non-ionic surfactants as viscosity modifiers cause optical and rheological stability problems at elevated ambient temperatures.

We have now found that a combination of a single chain cationic surfactant, which is an alkoxylated cationic quaternary ammonium surfactant, with a co-fragmenting agent, such as a polyol, in a concentrated liquid fabric softener composition containing an ester-linked cationic softener compound, unexpectedly gives rise to excellent storage stability of the concentrated fabric softener composition across a range of temperature conditions, including elevated temperatures. The liquid softener composition of the invention does not suffer from excessive thickening and the pearly appearance is preserved. This optical and rheological stability is achieved by compositions prepared using a specific order of mixing of the components, namely by adding a co-melt of the cationic softener and the single chain cationic surfactant into water containing the co-fragmenting agent.

Appearance of the Softener Compositions

Cationic fabric softener compositions form lamellar gel structures. This structure is characterised by stacks of alternate layers of cationic active and water. For electrolyte-free systems the thickness of the water layers could, in theory, be infinite. This means that small concentrations of cationic softener dispersed in water can give rise to a large viscosity or thick dispersion. When the concentration of cationic softener increases further the liquid becomes very thick and difficult to flow (i.e. it forms a gel). Therefore, aqueous liquid cationic fabric softeners with concentrations above ca 8 wt % require the use of a formulation aid.

To reduce the viscosity one needs to reduce the volume occupied by the large spherical cationic softener particles (called liposomes). One way to achieve this is by using micelle-forming surfactants to force the cationic softener to form smaller particles (or "fragments"), thus reducing the phase volume.

The appearance of the cationic fabric conditioner composition is related to its molecular arrangement. Desirable appearance is pearly or clear, whilst fabric conditioners which have a milky or marbled appearance are less luxurious and less desirable. These types of appearance are, for the purposes of this patent, as described below:

Milky: the liquid contains spherical liposome particles of cationic softener, which reflect light back at random giving it a whitish, opaque appearance.

Pearly: As the spherical liposomes are broken down into fragments, the liquid becomes less milky and more pearly. The fragments are tiny sheet-like flakes of liposome, which orient themselves to give a non-random reflection of light and a characteristic pearly appearance. This appearance is highly desirable for cueing a rich and luxurious liquid.

As mentioned earlier a problem with the desirable fragmented pearly liquids created by the use of ethoxylated nonionics is that they are relatively unstable at elevated temperatures. Presence of perfume aggravates this instability and promotes faster thickening.

Clear: As the fragments get smaller and smaller, for example with addition of high levels of nonionic or cationic surfactant the liquid becomes more clear. High levels of solvent has also been used in the past to increase the clarity of these liquids.

Marbled: At elevated temperatures the fragments stick together and become large sheets resulting in the liquid appearance becoming striated, often with a marbled effect. This optical change accompanies the thickening phenomenon where the flow property becomes stringy and undesirable. Such liquids do not disperse well in water.

It is an aim of the present invention to provide fabric conditioner compositions having a stable pearly appearance, which is maintained on storage under a range of temperature conditions.

We have now surprisingly found that the use of single chain cationic surfactants in combination with a polyol such as sucrose or glycerol gives a synergistic improvement in stability. The pearly appearance remains unchanged.

DEFINITION OF THE INVENTION

According to a first aspect of the present invention, there is provided a concentrated liquid fabric softening composition comprising:

i) from 10% to 40%, by weight of the total composition, of an ester-linked triethanolamine (TEA) quaternary ammonium fabric softening material comprising a mixture of mono-, di- and tri-ester linked components;

ii) from 0.1% to 20%, by weight of the total composition, of a single long chain cationic surfactant; and iii) from 0.1% to 20%, by weight of the total composition, of a co-fragmenting agent;

wherein the TEA quaternary ammonium fabric softening material contains at least 10% mono-ester (by weight of the quaternary material) and has an Iodine Value of between 0 and 60, the single long chain cationic surfactant has one or more ethoxylate groups and preferably has a methylsulphate counter-ion, and the co-fragmenting agent is a polyol selected from trihydric and polyhydric polyols.

According to a second aspect of the present invention, there is provided a method for the treatment of fabrics comprising contacting fabrics with a concentrated liquid fabric softening composition according to the first aspect of the invention or any of the particular variants thereof disclosed in the following description.

According to a third aspect of the present invention, there is provided a method for the manufacture of a concentrated liquid fabric softening composition according to the first aspect of the invention, comprising the steps of (a) preparing a co-melt of from 10% to 40%, by weight of the total composition, of an ester-linked triethanolamine (TEA) quaternary ammonium fabric softening material comprising a mixture of mono-, di- and tri-ester linked components and from 0.1% to 20%, by weight of the total composition of a single chain cationic surfactant, (b) adding the melt of step (a) into water containing 0.1% to 20%, by weight of the total composition, of a co-fragmenting agent, and (c) milling the resulting formulation from 0.5 to 3 times the batch volume, wherein the TEA quaternary ammonium fabric softening material contains at least 10% mono-ester (by weight of the quaternary material) and has an Iodine Value of between 0 and 60, the single long chain cationic surfactant has one or more ethoxylate groups and preferably has a methylsulphate counter-ion, and the co-fragmenting agent is a polyol selected from trihydric and polyhydric polyols.

DETAILED DESCRIPTION OF THE INVENTION

The Quaternary Ammonium Fabric Softening Material

The quaternary ammonium fabric softening material for use in compositions of the present invention is an ester-linked triethanolamine (TEA) quaternary ammonium compound comprising a mixture of mono-, di- and tri-ester linked components.

Typically, TEA-based fabric softening compounds comprise a mixture of mono, di- and tri-ester forms of the compound where the di-ester linked component comprises no more than 70% by weight of the fabric softening compound, preferably no more than 60%, e.g. no more than 55%, or even no more than 45% of the fabric softening compound, for example from 10 to 70%, preferably from 20 to 60%, more preferably from 25 to 55%, even more preferably from 30 to 45%; and at least 10% of the monoester linked component by weight of the fabric softening compound, for example from 10 to 50%, preferably from 25 to 45%, more preferably from 30 to 40%.

A first group of quaternary ammonium compounds (QACs) suitable for use in the present invention is represented by formula (I):

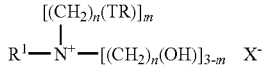

(I)

wherein each R is independently selected from a $C_{5-35}$ alkyl or alkenyl group; $R^1$ represents a $C_{1-4}$ alkyl, $C_{2-4}$ alkenyl or a $C_{1-4}$ hydroxyalkyl group; T is generally O—CO. (i.e. an ester group bound to R via its carbon atom), but may alternatively be CO.O (i.e. an ester group bound to R via its oxygen atom); n is a number selected from 1 to 4; m is a number selected from 1, 2, or 3; and $X^-$ is an anionic counter-ion, such as a halide or alkyl sulphate, e.g. chloride or methylsulphate. Di-esters variants of formula I (i.e. m=2) are preferred and typically have mono- and tri-ester analogues associated with them. Such materials are particularly suitable for use in the present invention.

Especially preferred agents are di-esters of triethanolamine methylsulphate, otherwise referred to as "TEA ester quats.". Commercial examples include Prapagen TQL, ex Clariant, and Tetranyl AHT-1, ex Kao, (both di-[hardened tallow ester] of triethanolamine methylsulphate), AT-1 (di-[tallow ester] of triethanolamine methylsulphate), and L5/90 (di-[palm ester] of triethanolamine methylsulphate), both ex Kao, and Rewoquat WE15 (a di-ester of triethanolamine methylsulphate having fatty acyl residues deriving from $C_{10}$-$C_{20}$ and $C_{16}$-$C_{18}$ unsaturated fatty acids), ex Witco Corporation.

The second group of QACs suitable for use in the invention is represented by formula (II):

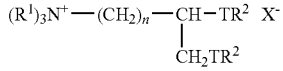

(II)

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; and wherein n, T, and $X^-$ are as defined above.

Preferred materials of this second group include 1,2 bis [tallowoyloxy]-3-trimethylamine propane chloride, 1,2 bis [hardened tallowoyloxy]-3-trimethylamine propane chloride, 1,2-bis[oleoyloxy]-3-trimethylamine propane chloride, and 1,2 bis[stearoyloxy]-3-trimethylamine propane chloride. Such materials are described in U.S. Pat. No. 4,137,180 (Lever Brothers). Preferably, these materials also comprise an amount of the corresponding mono-ester.

A third group of QACs suitable for use in the invention is represented by formula (III):

$$(R^1)_2—N^+—[(CH_2)_n\text{-}T\text{-}R^2]_2X^- \quad (III)$$

wherein each R group is independently selected from $C_{1-4}$ alkyl, or $C_{2-4}$ alkenyl groups; and wherein each $R^2$ group is independently selected from $C_{8-28}$ alkyl or alkenyl groups; and n, T, and $X^-$ are as defined above. Preferred materials of this third group include bis(2-tallowoyloxyethyl)dimethyl ammonium chloride and hardened versions thereof.

The iodine value of the quaternary ammonium fabric softening material is from 0 to 60, preferably from 0 to 45, more preferably from 0 to 30, and most preferably from 0 to 20.

Iodine value is defined as the number of grams of iodine absorbed per 100 g of test material. NMR spectroscopy is a suitable technique for determining the iodine value of the softening agents of the present invention, using the method described in *Anal. Chem.,* 34, 1136 (1962) by Johnson and Shoolery and in EP 593,542 (Unilever, 1993).

The softening agent is present in the compositions of the invention at a level of 10% to 40% by weight of the total composition, preferably between 10 to 30%.

The Single Long Chain Cationic Surfactant (Fragmenting Agent)

The single long chain cationic surfactant of the present invention has one or more ethoxylate groups and a counter ion which is preferably an alkyl sulphate, such as methyl sulphate and ethyl sulphate, and most preferably is a methylsulphate counter-ion.

The single long chain cationic surfactants for use in the present invention are alkoxylated cationic quaternary ammonium surfactants. Those suitable for use in this invention are generally derived from fatty alcohols, fatty acids, fatty methyl esters, alkyl substituted phenols, alkyl substituted benzoic acids, and/or alkyl substituted benzoate esters, and/or fatty acids that are converted to amines which can optionally be further reacted with another long chain alkyl or alkyl-aryl group; this amine compound is then alkoxylated with one or two alkylene oxide chains each having less than or equal to about 50 moles alkylene oxide moieties (e.g. ethylene oxide and/or propylene oxide) per mole of amine. Typical of this class are products obtained from the quaternization of aliphatic saturated or unsaturated, primary, secondary, or branched amines having one hydrocarbon chain from about 12 to about 22 carbon atoms alkoxylated with one or two alkylene oxide chains on the amine atom each having less than or equal to about 50 alkylene oxide moieties. The amine hydrocarbons for use herein have from about 12 to about 22 carbon atoms, and are preferably in a straight chain configuration. Suitable quaternary ammonium surfactants are made with one or two alkylene oxide chains attached to the amine moiety, in average amounts of less than or equal to about 50 moles of alkylene oxide per alkyl chain, more preferably from about 3 to about 20 moles of alkylene oxide, and most preferably from about 5 to about 12 moles of alkylene oxide per hydrophobic, e.g., alkyl group. Examples of suitable stabilizers of this type include Ethoquad® 18/25, C/25, and O/25 from Akzo and Variquat®-66 (soft tallow alkyl bis(polyoxyethyl) ammonium ethyl sulfate with a total of about 16 ethoxy units) from Goldschmidt.

Preferably, the compounds of the ammonium alkoxylated cationic surfactants have the following general formula: $\{R1_m\text{-}Y—[(R2\text{-}O)_z—H]_p\}^+X^-$, wherein R1 is selected from the group consisting of saturated or unsaturated, primary, secondary chain alkyl or alkyl-aryl hydrocarbons; said hydrocarbon chain having a length of from 12 to 22; each R2 is selected from the following groups or combinations of the following groups: $—(CH_2)n$- and/or $—[CH(CH_3)CH_2]—$; Y is selected from the following groups: $=N^+\text{-}(A)_q$; $—(CH_2)_n—N^+\text{-}(A)_q$; $—B—(CH_2)_n—N^+\text{-}(A)_2$; -(phenyl)-$N^+$-$(A)_q$; —(B-phenyl)-$N^+$-$(A)_q$; with n being from about 1 to about 4.

Each A is independently selected from the following groups: H; R1; —(R2O)—H; $—(CH_2)_xCH_3$; phenyl, and substituted aryl; where $0 \leqq x \leqq$ about 3; and B is selected from the following groups: —O—; —NA-; $—NA_2$; —C(O)O—; and —C(O)N(A)-; wherein R2 is defined as hereinbefore; q=1 or 2; and $X^-$ is and m is from 1 to 4.

Preferred structures are those in which m=1, p=1 or 2, and $5 \leqq z \leqq 50$, more preferred are structures in which m=1, p=1 or 2, and $7 \leqq z \leqq 20$, and most preferred are structures in which m=1, p=1 or 2, and $9 \leqq z \leqq 12$.

Preferred commercial surfactants include Surfac ARF, a tallow amine ethoxy ammonium methyl sulphate (ex Surfachem); Tomah QC-15, cocopoly (15) oxyethylene methyl ammonium chloride (ex Tomah Products); and Rewoquat CPEM, coco pentaethoxymethyl ammonium methosulphate (ex Witco).

The Co-Fragmenting Agent

The co-fragmenting agent is a sugar also known as a polyol selected from the list consisting of trihydric (e.g. glycerol) and polyhydric polyols. Suitable polyols include monosaccharides such as glucose and fructose and disaccharides such as sucrose, lactose and maltose. Other suitable polyols include arabitol, erythritol, isomalt, lactitol, maltitol, mannitol, sorbitol and xylitol.

The most preferred polyol co-fragmenting agents are sucrose and glycerol.

The molecular weight of the co-fragmenting agent is preferably less than 600, more preferably less than 500, most preferably less than 400.

Aqueous Continuous Phase

The co-fragmenting agent preferably exists in an aqueous continuous phase. The co-fragmenting agent and water typically comprise less than 90% by weight of the total formulation.

The aqueous continuous phase may also comprise water-soluble species, such as mineral salts or short chain ($C_{1-4}$) alcohols. The mineral salts may aid the attainment of the required phase volume for the composition, as may water soluble organic salts and cationic deflocculating polymers, as described in EP 41,698 A2 (Unilever). Such salts may be present at from 0.001 to 1% and preferably at from 0.005 to 0.1% by weight of the total composition. Examples of suitable mineral salts for this purpose include calcium chloride and magnesium chloride. The compositions of the invention may also contain pH modifiers such as hydrochloric acid. The short chain alcohols include primary alcohols, such as ethanol, propanol, and butanol, and secondary alcohols such as isopropanol. The short chain alcohol may be added with the cationic softening agent during the preparation of the composition.

Perfume

The compositions of the invention typically comprise one or more perfumes. The perfume is preferably present in an amount from 0.01 to 10% by weight, more preferably 0.05 to 5% by weight, most preferably 0.5 to 4.0% by weight, based on the total weight of the composition.

Co-Softener

Co-softeners may be used together with the cationic softening agent. When employed, they are typically present at from 0.1 to 20% and particularly at from 0.5 to 10%, based on the total weight of the composition. Preferred co-softeners include fatty esters, and fatty N-oxides.

Fatty esters that may be employed include fatty monoesters, such as glycerol monostearate, fatty sugar esters, such as those disclosed WO 01/46361 (Unilever).

Further Optional Ingredients

The compositions of the invention may contain one or more other ingredients. Such ingredients include preservatives (e.g. bactericides), pH buffering agents, perfume carriers, fluorescers, colourants, hydrotropes, antifoaming agents, anti-redeposition agents, soil-release agents, polyelectrolytes, enzymes, optical brightening agents, anti-shrinking agents, anti-wrinkle agents, anti-spotting agents, anti-oxidants, sunscreens, anti-corrosion agents, drape imparting agents, anti-static agents, ironing aids and dyes.

The products of the invention preferably do not contain pearlisers and opacifiers. The method of the invention inherently creates a pearly appearance.

The products of the invention preferably do not contain non-ionic surfactant.

Optional Complexing Agent

The compositions of the invention may include a complexing agent. Preferred complexing agents are fatty alcohols and fatty acids.

Such agents typically have a $C_8$ to $C_{22}$ chain present as part of their molecular structure. Suitable fatty completing agents include $C_8$ to $C_{22}$ fatty alcohols and $C_8$ to $C_{22}$ fatty acids; of these, the $C_8$ to $C_{22}$ fatty alcohols are most preferred. A fatty complexing agent is particularly valuable in compositions comprising a QAC having a single $C_{12-28}$ group connected to the nitrogen head group, such as mono-ester associated with a TEA ester quat or a quaternary ammonium fabric softening material of formula II.

Complexing the single chain QAC may aid the rheological stability of the composition in another manner; the presence of such single chain QACs, particular when present at levels of 10 mole % or greater of the total QAC, can lead to depletion flocculation—addition of a complexing agent has the effect of reducing their free concentration, thereby reducing or eliminating this problem. Enhanced softening performance may also result from the presence of the complex formed between the single chain QAC and the complexing agent.

Preferred fatty acid complexing agents include hardened tallow fatty acid (available as Pristerene, ex Uniqema).

Preferred fatty alcohol complexing agents include hardened tallow alcohol (available as Stenol and Hydrenol, ex Cognis, and Laurex CS, ex Albright and Wilson) and behenyl alcohol, a $C_{22}$ fatty alcohol, available as Lanette 22, ex Henkel.

The fatty complexing agent may be used at from 0.1% to 10%, particularly at from 0.5% to 5%, and especially at from 0.75 to 2% by weight, based on the total weight of the composition.

When a QAC having a single $C_{12-28}$ group connected to the nitrogen head group is present, the mole ratio of the fatty complexing agent to said single chain QAC is preferably from 1:3 to 3:1, more preferably 1:2 to 2:1, and most preferably 2:3 to 3:2.

Product Use

The compositions of the present invention are preferably rinse conditioner compositions and may be used in the rinse cycle of a domestic laundry process.

The composition is preferably used in the rinse cycle of a home textile laundering operation, where, it may be added directly in an undiluted state to a washing machine, e.g. through a dispenser drawer or, for a top-loading washing machine, directly into the drum. Alternatively, it can be diluted prior to use. The compositions may also be used in a domestic hand-washing laundry operation.

It is also possible, though less desirable, for the compositions of the present invention to be used in industrial laundry operations, e.g. as a finishing agent for softening new clothes prior to sale to consumers.

Method of Manufacture

Formulations according to the invention may be prepared by the method of manufacture described as the third aspect of the invention. The method may comprise the addition of an electrolyte, such as a mineral salt, and/or milling of the formulation. Milling of the formulation, when employed, is typically performed until at least half of the batch volume has passed through the mill, preferably all of the batch volume, most preferably the whole volume is passed through the mill up to three times.

In a typical method of manufacture, the cationic softening agent, cationic surfactant, and any optional components such as co-softener are heated together until a co-melt is formed. Water and co-fragmenting agent are heated and the co-melt is added to the water with stirring. The phase volume of the disperse phase may be reduced by the addition of an electrolyte and/or by milling, preferably whilst the mixture is still hot, while it goes through its phase transition and when it is cold.

Electrolyte may be added; generally any of the alkaline metals or alkaline earth metal salts of the mineral acids can be used as electrolyte. NaCl, $CaCl_2$, $MgCl_2$ and $MgSO_4$ and similar salts of alkaline and alkaline earth meals are preferred and $CaCl_2$ is especially preferred. The amount of electrolyte will be selected to assure that the composition reaches the viscosity below 500 cps and more preferably 250 cps. Generally, amounts of electrolyte salt needed are from 0.01 to 1.0 wt %, preferably from 0.01 to 0.40 wt %, by weight of the total composition.

EXAMPLES

The invention will now be illustrated by the following non-limiting examples. Further modifications will be apparent to the person skilled in the art.

Examples of the invention are represented by a number. Comparative examples are represented by a letter.

Example 1

Preparation of Compositions 1-3 in Accordance with the Invention 200 ml of liquid fabric softener compositions 1 and 2 are prepared in a stirred vessel at 75° C. as follows: Water and co-fragmenting agent are weighed into the vessel. Softener and surfactant are melted together and added to aqueous co-fragmenting agent with agitation. After 10 minutes the mixing vessel is cooled to 30° C. via recirculation of cold water and the contents transferred to bottles for storage.

300 ml of fabric softener composition 3 is prepared by co-melting the surfactant and softener together and adding to water containing the dye and preservative (with co-fragmentor) at 75° C. under agitation. After 5 minutes extra mixing the batch is cooled to about 30° C. by recirculation of cold water and then perfume is added with 2 minutes extra mixing.

The compositions are shown in Table 1 below.

TABLE 1

Compositions of liquid fabric softeners 1-3.

| INGREDIENT | 1 | 2 | 3 |
|---|---|---|---|
| CATIONIC SOFTENER | | | |
| DEEDMAC (Hardened tallow, 85%) | 14.29 | — | — |
| HEQ (S 3956) 78% (Ex Clariant) | — | 15.47 | — |
| TEA quat Stepantex UL85 (85%) (Ex Stepan) | — | — | 13.5 |
| SINGLE LONG CHAIN CATIONIC SURFACTANT | | | |
| Surfac ARF[1] (ex Surfachem) | 1.30 | | 1.35 |
| Rewoquat CPEM[2] (ex Witco) | | 1.93 | |
| CO-FRAGMENTING AGENT | | | |
| Glycerol | 2 | 2 | — |
| Sucrose | — | — | 1 |
| WATER AND MINORS | | | |
| Perfume (SL B53 PCMF) (ex Givaudan) | — | — | 0.90 |
| Dye (1% solution) Patent Blue V85 | — | — | 3 drops |
| Preservative (Proxel GXL, 20% active, ex Arch Chemicals) | — | — | 3 drops |
| Demineralised water | to 100 | to 100 | to 100 |

[1]a tallow amine ethoxy ammonium methyl sulphate
[2]a coco pentaethoxymethyl ammonium methylsulphate.

What is claimed is:

1. A concentrated liquid fabric softening composition comprising:

i) from 10% to 40%, by weight of the total composition, of an ester-linked triethanolamine (TEA) quaternary ammonium fabric softening material comprising a mixture of mono-, di- and tri-ester linked components;

ii) from 0.1% to 20%, by weight of the total composition, of a single long chain cationic surfactant; and iii) from 0.1% to 20%, by weight of the total composition, of a co-fragmenting agent;

wherein the TEA quaternary ammonium fabric softening material contains at least 10% mono-ester (by weight of the quaternary material) and has an Iodine Value of between 0 and 60, the single long chain cationic surfactant has one or more ethoxylate groups and preferably has a methylsulphate counter-ion, and the co-fragmenting agent is a sugar or sugar alcohol.

2. A fabric softening composition according to claim 1, wherein the co-fragmenting agent has a molecular weight of less than 600, more preferably less than 500, and most preferably less than 400.

3. A fabric softening composition according to claim 1, wherein the sugar or the sugar alcohol is selected from the group consisting of sucrose, lactose, maltose, glucose, fructose, arabitol, erythritol, isomalt, lactitol, maltitol, mannitol, sorbitol and xylitol.

4. A fabric softening composition according to claim 3, wherein the sugar is sucrose.

5. A fabric composition according to claim 1, wherein the ester-linked triethanolamine quaternary ammonium fabric softening material has an iodine value of from 0 to 60, preferably from 0 to 45, more preferably from 0 to 30, and most preferably from 0 to 20.

6. A fabric softening composition according to claim 1, wherein the ester-linked triethanolamine quaternary ammonium fabric softening material comprises no more than 70% of the di-ester linked component, by weight of the fabric softening compound, and at least 10% of the mono-ester linked component.

7. A fabric softening composition according to claim 1, wherein the co-fragmenting agent and water comprise less than 90% by weight of the total composition.

8. A fabric softening composition according to claim 1, which further comprises a fatty complexing agent selected from a fatty alcohol and a fatty acid.

9. A method for the treatment of fabrics comprising contacting fabrics with a liquid fabric softening composition according to claim 1.

10. A method for the manufacture of a concentrated liquid fabric softening composition comprising:

(a) preparing a co-melt of from 10% to 40%, by weight of the total composition, of an ester-linked triethanolamine (TEA) quaternary ammonium fabric softening material comprising a mixture of mono-, di- and tri-ester linked components and from 0.1% to 20%, by weight of the total composition, of a single chain cationic surfactant, (b) adding the melt of (a) into water containing 0.1% to 20%, by weight of the total composition, of a co-fragmenting agent; and (c) milling the resulting formulation from 0.5 to 3 times the batch volume, wherein the TEA quaternary ammonium fabric softening material contains at least 10% mono-ester (by weight of the quaternary material) and has an Iodine Value of between 0 and 60, the single long chain cationic surfactant has one or more ethoxylate groups and preferably has a methylsulphate counter-ion, and the co-fragmenting agent is a sugar or a sugar alcohol.

11. A method according to claim 10, which further comprises adding an electrolyte.

12. The method according to claim 10, wherein the sugar or the sugar alcohol is selected from the group consisting of sucrose, lactose, maltose, glucose, fructose, arabitol, erythritol, isomalt, lactitol, maltitol, mannitol, sorbitol and xylitol.

13. The method according to claim 10, wherein the sugar is sucrose.

* * * * *